US007438272B2

(12) United States Patent
Kee et al.

(10) Patent No.: US 7,438,272 B2
(45) Date of Patent: Oct. 21, 2008

(54) DEVICE FOR AVOIDING INATTENTIVE-FALL OF LEGGED FURNITURE ARTICLE

(75) Inventors: Lee Choo Kee, 16/F, Flat F, Block 12, Laguna City, Kowloon (HK); Kai Yip Li, Kowloon (HK)

(73) Assignee: Lee Choo Kee, Kowloon, Hong Kong (HK)

( * ) Notice: Subject to any disclaimer, the term of this patent is extended or adjusted under 35 U.S.C. 154(b) by 85 days.

(21) Appl. No.: 11/514,168

(22) Filed: Sep. 1, 2006

(65) Prior Publication Data

US 2007/0272810 A1 Nov. 29, 2007

(30) Foreign Application Priority Data

May 24, 2006 (CN) ..... 2006 1 0084118

(51) Int. Cl.
*A47F 5/00* (2006.01)
*E04G 25/00* (2006.01)
*F16M 13/00* (2006.01)

(52) U.S. Cl. ..... 248/351; 248/129; 248/188.9; 248/188.91; 16/30; 16/35 R; 297/463.1; 297/463.2; 297/270.1; 297/270.2; 297/270.3; 297/270.4; 297/270.5

(58) Field of Classification Search ..... 248/129, 248/351, 188.9, 188.91; 16/30, 35 R; 297/463.1, 297/463.2, 270.1–270.5
See application file for complete search history.

(56) References Cited

U.S. PATENT DOCUMENTS

| | | | | | |
|---|---|---|---|---|---|
| 691,532 | A * | 1/1902 | Clark | 16/30 |
| 1,004,550 | A * | 10/1911 | Bertke | 182/21 |
| 2,658,587 | A * | 11/1953 | Velazquez | 188/4 R |
| 3,863,945 | A * | 2/1975 | Dunstan | 280/35 |
| 3,871,783 | A * | 3/1975 | Vogler | 403/205 |
| 4,424,604 | A * | 1/1984 | Dupuis | 16/29 |
| 4,974,284 | A * | 12/1990 | Campbell | 16/29 |
| 5,499,856 | A * | 3/1996 | Sorrell et al. | 297/5 |
| 5,586,803 | A * | 12/1996 | Overpeck | 297/158.3 |
| 5,832,560 | A * | 11/1998 | DePalma | 16/30 |
| 7,040,635 | B1 * | 5/2006 | Remole | 280/47.18 |

FOREIGN PATENT DOCUMENTS

| | | |
|---|---|---|
| DE | 3207799 | 9/1983 |
| DE | 10203142 | 8/2003 |

* cited by examiner

*Primary Examiner*—Anita M. King
*Assistant Examiner*—Nkeisha J Dumas
(74) *Attorney, Agent, or Firm*—Rabin & Berdo, P.C.

(57) ABSTRACT

The invention provides a device for avoiding inattentive-fall of a legged furniture article, comprising a support means having a cavity for passage of a leg member of the furniture article; and at least one roller rotatably attached to the support means, wherein the roller and the cavity are arranged vertically in a staggered mode. In the device of the invention, a simple one-way roller structure is used in order to enhance greatly the stability of the furniture article as well as impart the advantages of easy installation and convenient use to the device of the invention.

5 Claims, 6 Drawing Sheets

DEVICE FOR AVOIDING INATTENTIVE-FALL OF LEGGED FURNITURE ARTICLE

FIELD OF THE INVENTION

The present invention relates to an accessory for a furniture article, and particularly to a device for avoiding inattentive-fall of a legged furniture article.

DESCRIPTION OF RELATED ART

Fall of currently household chairs may not take place for an adult with his common sense and balance capacity, but such a fall frequently happens to a child who is fond of climbing and has a poor balance capacity, with a consequence of causing injury to himself. There is thus a need for providing a device for use in legged furniture articles. Detailed analysis of VEMD (*Victorian Emergency Minimum Dataset, January* 1996 *to December* 1999) data indicated that low falls from chairs/stools, tables/benches and conventional beds were most frequently found in children aged 1-4 years and chairs ranked first among them. Additional statistic data showed that 17,127,000 families have children aged under 6 in USA (*US Census Bureau,* 2003) and 242,474 families have children aged under 5 in Hong Kong (2001 *Population Census, Hong Kong*). Accordingly, there is a potential demand for each of these families to use at least one pair of such a device for avoiding inattentive-fall of a legged furniture article.

German Patent No. DE10203142A1 discloses a device for allowing a chair to tilt backward safely (see. FIG. 1). The chair is fitted at the underside of its seat 1 with a support frame 2 comprising two legs 3 each having a roller 6 attachable to its lower end, a joint 9 for rotatably attaching the legs 3 to the bottom of the seat 1, and a stopper 5 for constraining movement of the legs 3. Said two legs 3 enables the support surface of the chair to be increased significantly so that the center of gravity of the chair, when tilted backward, remains within this support surface to keep balance of the chair, thus preventing the chair from overturn. However, the technical solution disclosed in this patent suffers from the following: 1. fixation of the support frame to the chair is required by use of a specialized installation procedure, so that it is not convenient to use; 2. the device is designed for a special-purpose chair, with the result of limited usages and applications; and 3. fixation of the support frame to the chair damages the overall esthetical appearance of the chair.

German Patent No. DE3207799A1 discloses an anti-tilt device for a chair (see FIG. 2), comprising a stand 5 for a chair leg and a roller 3 attachable to one side of the lower portion of the stand 5, the roller 3 being about 0.1 cm above the floor surface. The roller 3 touches the floor surface to support the chair when the chair is forced to tilt backward and the chair legs are lifted up from the floor surface. Rolling action of the roller 3 enables the chair to move in the force-bearing direction without overturn. However, it is possible that the chair is caused to fall when a greater force is applied thereto due to the use of two-way rollers 3.

Accordingly, there exists a need for an anti-tilt device for furniture articles and particularly for chairs with adaptability, convenience and artistic quality.

SUMMARY OF THE INVENTION

A device for avoiding inattentive-fall of a legged furniture article is presented, which overcomes the problems noted above and is safe and convenient to use.

According to the invention, a device for avoiding inattentive-fall of a legged furniture article, comprising:

a support means having a cavity for passage of a leg member of the furniture article; and at least one roller rotatably attached to the support means, wherein the roller and the cavity are arranged vertically in a staggered mode.

Preferably, the cavity is an endless connection through hole.

Preferably, the connection through hole is formed as a half-open channel.

Preferably, the support means is made integrally and secured to the leg member of the furniture article via the connection through hole.

Preferably, the support means includes a left portion on which a left slot is formed and a right portion on which a right slot is formed, wherein the left and right portions are fitted with each other in order that the left and right slots are coupled to form the connection through hole via which the support means is secured to the leg member of the furniture article.

Preferably, the support means includes a front portion on which a front slot is formed and a rear portion on which a rear slot is formed, wherein the front and rear portions are fitted with each other in order that the front and rear slots are coupled to form the connection through hole via which the support means is secured to the leg member of the furniture article.

In one preferred embodiment of the invention, the support means includes a pair of substantially T-shaped members each having two transverse arms and a roller arm which is substantially perpendicular to the transverse arms; and three connection members which are respectively connected on the ends of the respective arms to keep the substantially T-shaped members in a parallel and spaced relation to define the support means with the cavity, wherein the connection member connected on the ends of the roller arm acts as a roller spindle to which the at least roller is attached.

Preferably, the transverse arms of each substantially T-shaped member are respectively provided with one or more through holes and each connection member has two ends with internal threads to allow connection of said ends with engagable screws extending said through holes, in such a manner that the connection members are fixed to the substantially T-shaped members.

Preferably, the transverse arms of each substantially T-shaped member are respectively provided with one or more through holes and each connection member extends through said through holes and has two ends with external threads to allow connection of each of said ends with two engagable screw nuts at two sides of the corresponding transverse arm, in such a manner that the connection members are fixed to the substantially T-shaped members.

Preferably, the transverse arms of each substantially T-shaped member are respectively provided with one or more through holes and each connection member has one end with internal threads and another end with external threads, wherein the end with internal threads is connected with an engagable screw extending through said through hole of one transverse arm, the end with external threads extends through said through hole of another transverse arm to be connected with two engagable screw nuts at two sides of said transverse arm, in such a manner that the connection members are fixed to the substantially T-shaped members.

Preferably, the transverse arms of each substantially T-shaped member are respectively provided with one or more threaded holes and each connection member is a screw bolt having two ends with external threads to allow connection of said ends with said threaded holes of the transverse arms, in such a manner that the connection members are fixed to the substantially T-shaped members.

Preferably, the transverse arms of each substantially T-shaped member are respectively provided with a corresponding toothed groove which is formed as a open groove comprising a plurality of teeth along one edge thereof and which engages the connection member.

Preferably, the pair of the transverse arms and the roller arm of the substantially T-shaped member are manufactured integrally, wherein the transverse arms and the roller arm define a joint portion having a threaded hole into which a screw bolt is screwed, one end of the screw bolt extending into the cavity and another end of the screw bolt being used as a clamping end.

Preferably, the end of the screw bolt extending into cavity is fitted with a rubber pad.

Preferably, two rollers are used and respectively arranged at the outer sides of the roller arm.

Preferably, the roller is a one-way roller.

The roller structure is staggered in the vertical direction with respect to the rear leg member of the furniture article to provide better stability of the furniture article. Apart from this, the device of the invention is structurally simple for easy installation by a user where desired and can fit onto different types of furniture legs of different sizes, shapes and inclinations due to the design of a plurality of through holes/slots for adjusting the spacing. In the device of the invention, a one-way roller is used to make the furniture article safer when it is forced to tilt backward.

To have a better understanding of the invention reference is made to the following detailed description of the invention and embodiments thereof in conjunction with the accompanying drawings.

BRIEF DESCRIPTION OF THE DRAWINGS

FIG. 3(*b*) is a perspective view of the device of FIG. 3(*a*);

FIG. 5(*b*) is a diagram of the force analysis of the device of FIG. 3(*a*) when the chair is in the progress of tilting backward;

FIG. 7(*b*) is a right view of the device of FIG. 7(*a*);

FIG. 9(*b*) is a right view of the device of FIG. 9(*a*);

FIG. 12(*b*) is a right view of the device of FIG. 12(*a*);

DETAILED DESCRIPTION OF THE PREFERRED EMBODIMENT

Figure 1:
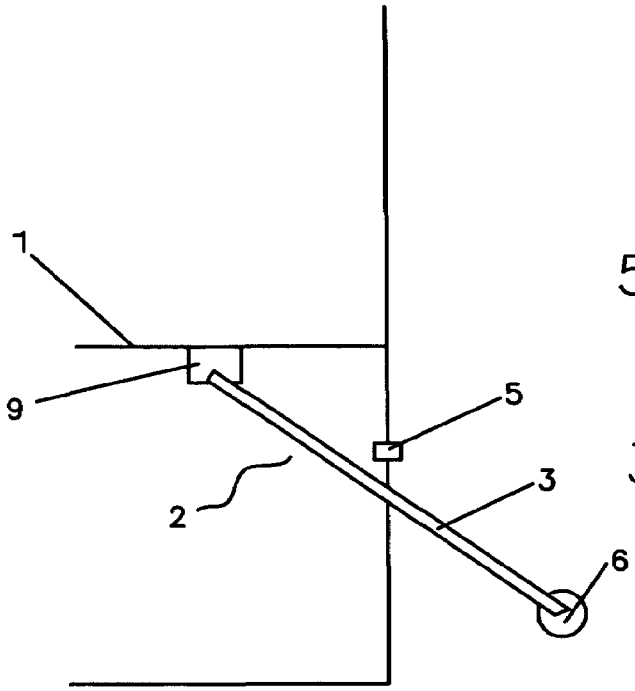
FIG. 1 is a schematic view of construction of the device disclosed in German Patent No. DE10203142A1.
Figure 2:
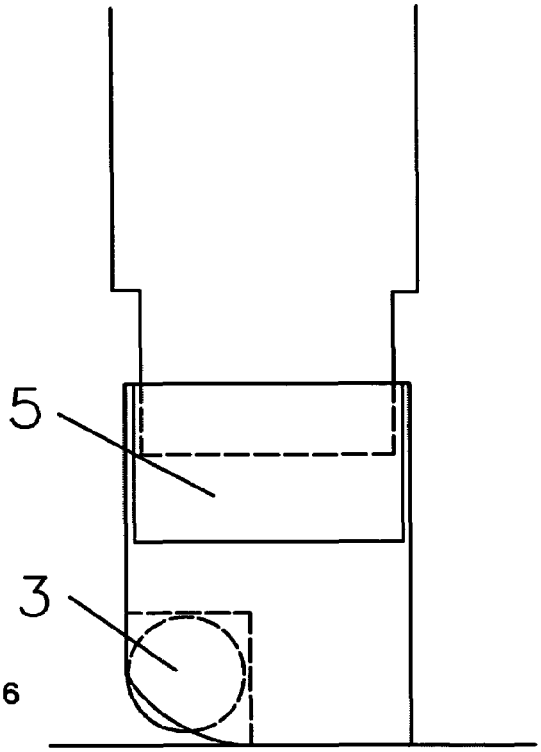
FIG. 2 is a schematic view of construction of the device disclosed in German Patent No. DE3207799A1.

Referring now to the drawings wherein the showings are for purposes of illustrating preferred embodiments of the present invention only, and not for purposes of limiting the same.

Figure 3A:
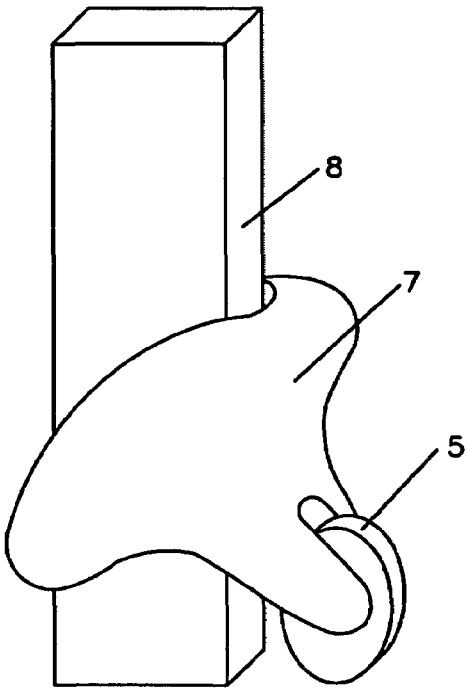
FIG. 3(*a*) is a schematic view of a device for avoiding inattentive-fall of a legged furniture article constructed consistent with a first preferred embodiment of the invention with the device attached to a leg member of the furniture article.
Figure 3B:
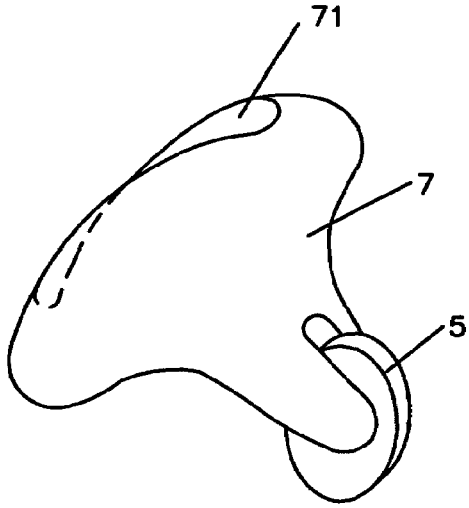

FIGS. 3(*a*) and 3(*b*) illustrate a device for avoiding inattentive-fall of a legged furniture article consistent with a first preferred embodiment of the present invention. In this embodiment, the device comprises a support means 7 and a roller 5 rotatably attached to the support means 7. The support means 7 is manufactured integrally and has a cavity for allowing passage of a leg member 8 of the furniture article. The roller 5 and the cavity are arranged in a staggered mode in the direction perpendicular to the floor surface so that the leg member 8 touches the floor surface during normal usage of the furniture article. As shown in FIGS. 3(*a*) and 3(*b*), the cavity is an endless connection through hole 71 which is of size and shape matched to the leg member 8. Advantageously, an elastic element such as a rubber pad is affixed to the inner surface of the connection through hole 71 for tightly connecting the connection through hole 71 with the leg member 8 and protecting the appearance of the leg member 8. When it is desirable to attach the device to the furniture article, the leg member 8 is allowed to pass through the connection through hole 71 via which the support means 7 is secured to the leg member 8.

Figure 6:
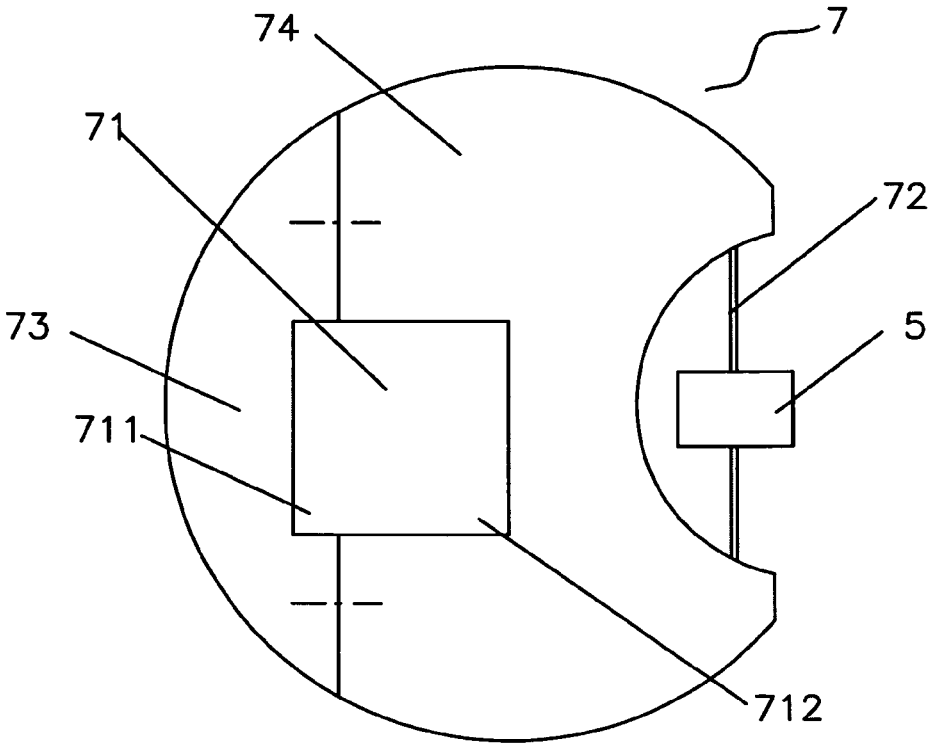
FIG. 6 is a schematic top view of construction of a device for avoiding inattentive-fall of a legged furniture article constructed consistent with a second preferred embodiment of the invention.

Apparently, attachment of the roller 5 to the support means 7 can be readily produced by one skilled in the art. In this embodiment, a roller spindle 72, on which the roller 5 is rotatably mounted, is arranged on the support means 7 (FIG. 6). The roller 5 can also be rotatably attached to the support means 7 by means of welding, screw connection, pin joint technologies, which are within the skill of those working in the art.

The connection through hole 71 may be formed as a half-open channel for easing attachment of the support means 7 to the leg member 8.

Figure 4:
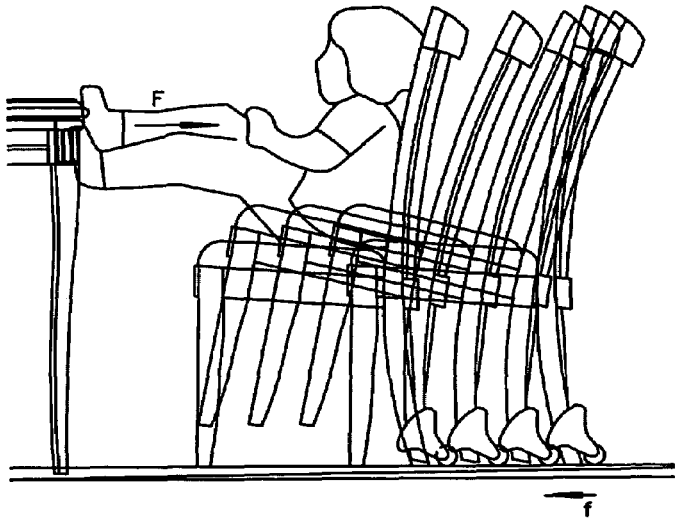
FIG. 4 is a schematic view of the device of FIG. 3(*a*) in the state of use.

Referring now to FIG. 4, the invention is designed based on the principle that attachment of the roller to the leg member of the furniture article allows the change of the sliding friction between the leg member and the floor surface to the rolling friction between the roller and the floor surface. It is obvious that a rolling friction force produced is greatly smaller than a sliding friction force produced under action of a same external force. Therefore, there occurs a relatively small reactive force f in a resistance to the backward tilting force F when the roller is mounted, thereby ensuring a translational motion of the furniture article against the reactive force f in the direction of the backward tilting force F instead of fall of the furniture article. In this way, the device of the invention provides the stability of the legged furniture article.

Figure 5A:
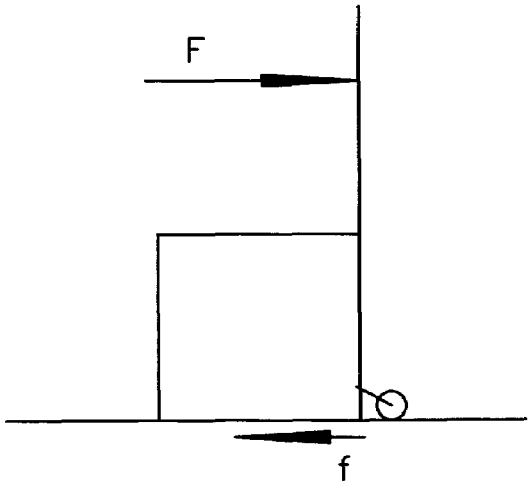
FIG. 5(*a*) is a diagram of the force analysis of the device of FIG. 3(*a*) in use.
Figure 5B:
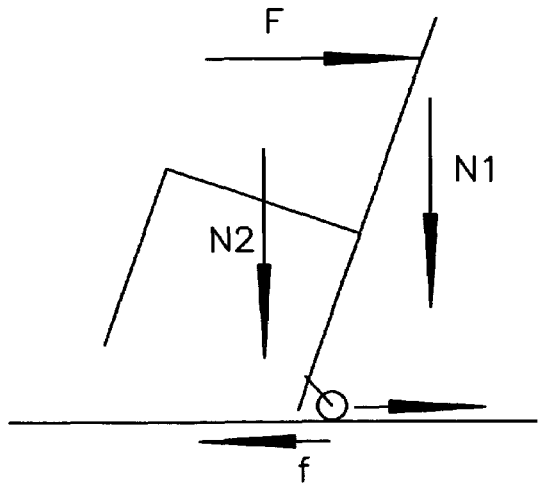

FIGS. 5*a* and 5*b* illustrate diagrams of the force analysis of the device of FIG. 3(*a*). The legged furniture article is supported on the floor surface via its three or more leg members (via its four leg members in most cases) as support points during normal usage. The gravity center of this furniture article falls within a support surface defined by said support points to maintain balance of the furniture article. When a backward tilting force F (a backward moving gravity force in some circumstances) is applied to the furniture article, front leg members of the furniture article are usually raised from the floor surface so that two rear leg members are and even one rear leg member only is used as a support point(s). Under such a circumstance, whether the furniture article is tilted backward or not depends on a differential value between a backward tilting torsion N1 generated by the backward tilting force F and a return torsion N2 generated by the gravity force of the furniture article. The furniture article will not fall if the backward tilting torsion N1 is smaller than the return torsion N2 and will fall if the backward tilting torsion N1 is greater than the return torsion N2.

FIG. 6 shows a device for avoiding inattentive-fall of a legged furniture article consistent with a second preferred embodiment of the present invention. This embodiment is substantially structurally identical with the first embodiment, but differing in that the support means 7 includes a front portion 73 on which a front slot 711 is formed and a rear portion 74 on which a rear slot 712 is formed. The front and rear slots 711, 712 are coupled to form the connection through hole 71 via which the support means 7 is secured to the leg member 8 of the furniture article, when the front and rear portions 73, 74 are assembled.

The front and rear portions 73, 74 may be assembled by means of conventional connections, for example, screw bolt, pin joint, bonding and the like. According to the invention, the device can fit leg members 8 which are of different sizes, for example, by inserting one or more spacers between the fitting faces of the front and rear portions 73, 74 to adjust the inner diameter of the connection through hole 71.

The device of the second embodiment enables attachment of the support means 7 to the leg member 8 without lifting up the furniture article, particularly suitable for a furniture article that is relatively heavy or inconvenient to be lifted up, by use of the design of inclusion of separate portions for the support means 7.

Likewise, a left portion and a right portion or separate portions in other forms may be included in the support means 7. Assembly of the left and right portions or of said separate portions may produce the support means 7, which are within the skill of those working in the art.

Figure 7A:
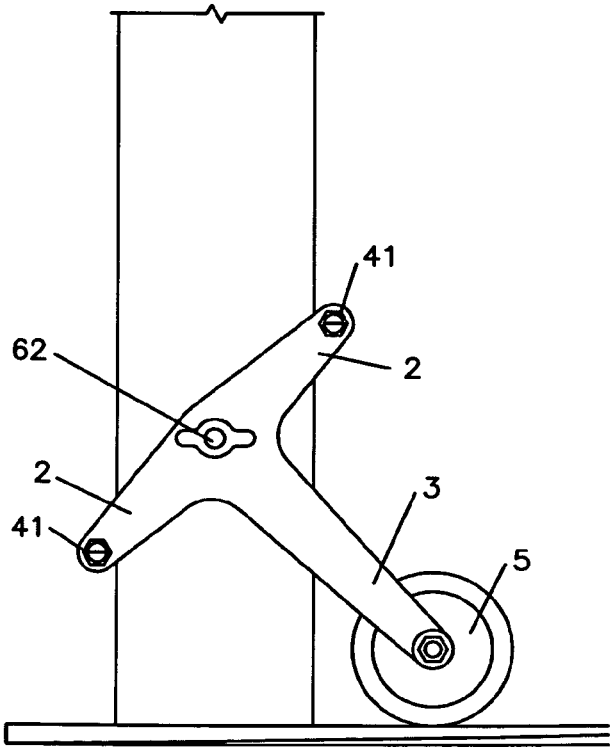
FIG. 7(*a*) is a schematic view of construction of a device for avoiding inattentive-fall of a legged furniture article constructed consistent with a third preferred embodiment of the invention with the device attached to a leg member of the furniture article.
Figure 7B:
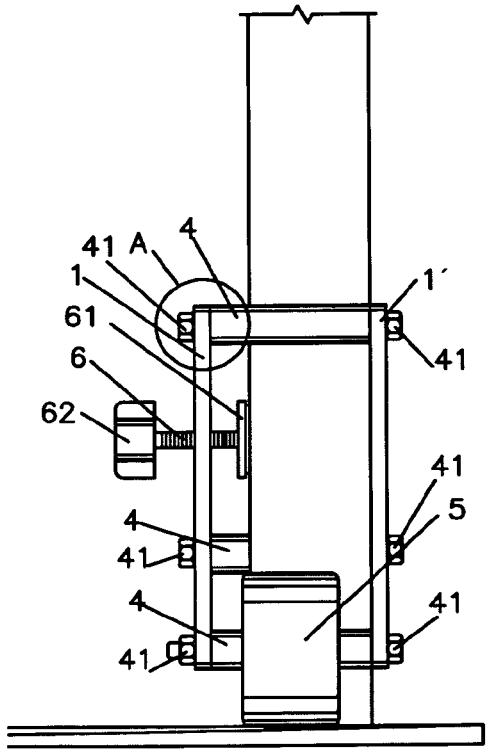
Figure 8:
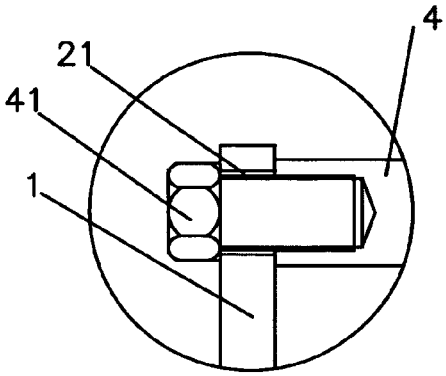
FIG. 8 is a partial view of Section A of FIG. 7(*b*)

Referring to FIGS. 7*a* and 7*b*, there is illustrated a device for avoiding inattentive-fall of a legged furniture article consistent with a third preferred embodiment of the invention, comprising a pair of substantially T-shaped members 1, 1' which are of generally same configuration, size and structure. Each of the substantially T-shaped members 1, 1' has two transverse arms 2 with a respective through hole 21, and a roller arm 3 which is substantially perpendicular to the transverse arms (FIG. 8). The transverse arms 2 and the roller arm 3 are made integrally. In this embodiment, the device further comprises three cylindrical connection members 4 with a diameter slightly greater than an inner diameter of the through hole 21 to ensure non-passage of the connection member 4 therethough. Each connection member has two ends with internal screws. Said ends each is connected with a screw extending through the through hole 21, in such a manner that said three connection members 4 are secured to the pair of substantially T-shaped members 1, 1'. Said three connection members 4 are respectively connected on the ends of the transverse arms 2 and the roller arm 3 to keep the substantially T-shaped members 1, 1' in a parallel and spaced relation to define the support means 7. The connection member 4 connected on the ends of the roller arm 3 acts as a roller spindle to which the roller 5 is attached.

Referring now to FIG. 7*b*, the pair of the transverse arms 2 and the roller arm 3 define a joint portion where a threaded hole is arranged. A screw bolt 6 is screwed into the threaded hole with one end of the screw bolt 6 extending into the support means 7 and another end of the screw bolt 6 being used as a clamping end 62. The end extending into the support means 7 is fitted with a rubber pad 61 in order to prevent the external surface of the leg member 8 from being damaged. The clamping end 62 serves for conveniently adjusting the screw bolt for its extension length into the support means 7 to fit leg members of different sizes.

When used, the device is secured to the leg member 8 by introducing the leg member 8 between two connection members 4 attached to two transverse arms 2 of the device, followed by location of the roller arm 3 as shown in FIGS. 7*a* and 7*b* as well as fastening the screw nuts 6. In a general way, use of a pair of devices is considered for two rear leg members of the furniture article. It shall be understood that one or more devices of the invention may be used where desired.

Figure 9A:
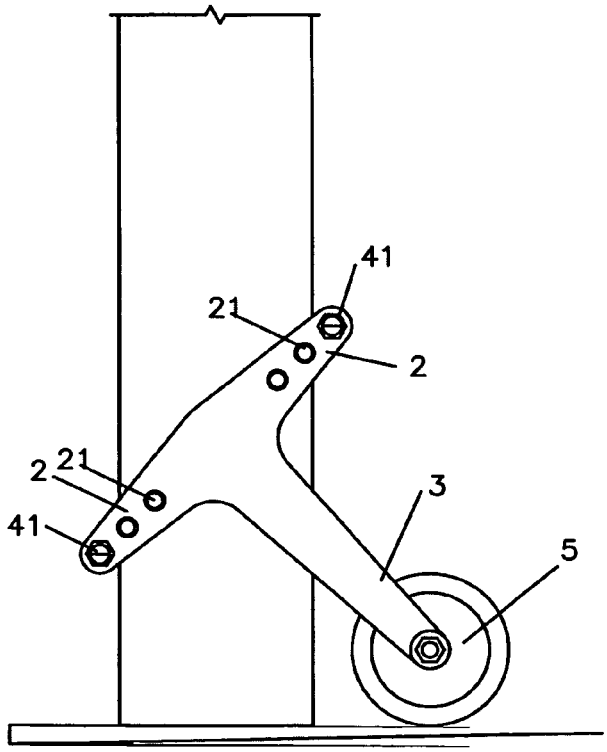
FIG. 9(*a*) is a schematic view of construction of a device for avoiding inattentive-fall of a legged furniture article constructed consistent with a fourth preferred embodiment of the invention with the device attached to a leg member of the furniture article.
Figure 9B:
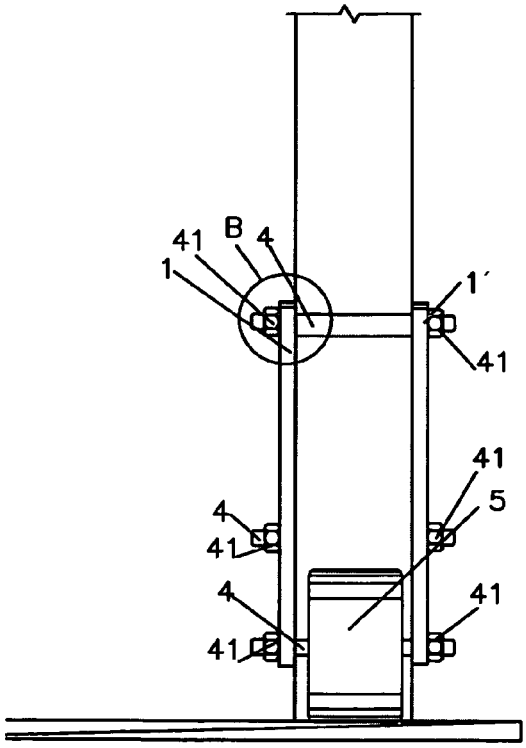
Figure 10:
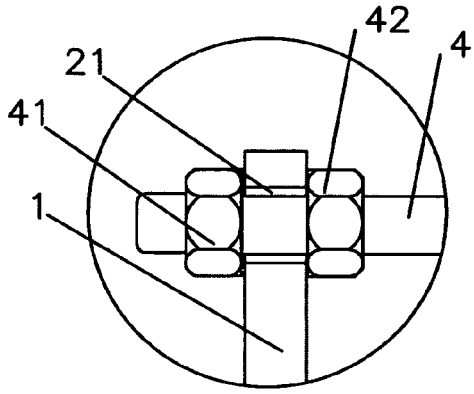
FIG. 10 is a partial view of Section B of FIG. 9(*b*)

FIGS. 9*a* and 9*b* illustrate a device for avoiding inattentive-fall of a legged furniture article consistent with a fourth preferred embodiment of the invention. This embodiment is substantially structurally identical with the above-mentioned embodiments, but differing in that each end of the connection member 4 is provided with external screws and extends through the through hole 21 for connection with two engagable screw nuts 41, 42 arranged at two sides of the corresponding substantially T-shaped member 1 or 1' (FIG. 10). Fastening said two ends to said screw nuts enables fixation of each connection member 4 to the substantially T-shaped members 1, 1'. In this embodiment, removal of screw bolts 6 is achieved while the device possesses the ability of adjusting the positions of two screw nuts 41, 42 on the connection member 4 to thereby change the spacing between the two substantially T-shaped members 1, 1', in order to fit leg members 8 of different sizes.

As shown in FIG. 9*a*, each transverse arm 2 has three through holes 21, allowing a user to position the two connection members 4 on the transverse arms in a different spaced relation. As a result, the device of this embodiment can fit leg members 8 of different sizes.

Figure 11:
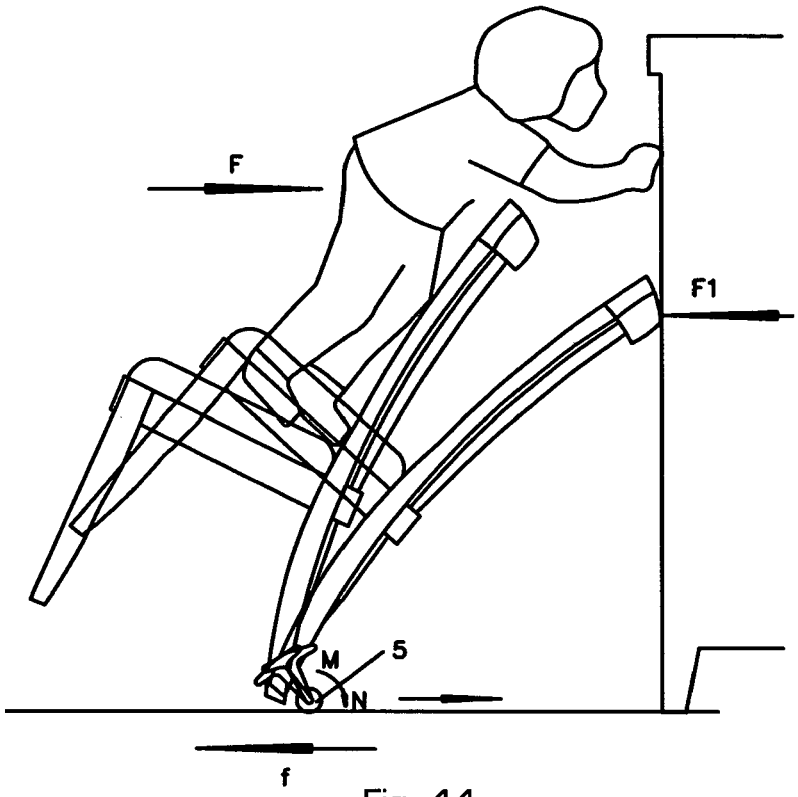
FIG. 11 is a schematic view of the device of FIG. 9(*a*) in the state of use.

FIG. 11 is a schematic view of the device of FIG. 9(*a*) in the state of use, differing from the third embodiment in that the roller 5 is a one-way roller which confines the roller 5 rolls in a manner that the furniture article is driven to move toward the backside thereof, i.e., the roller 5 is caused to rotate along the arrow of M to N only.

When the furniture article starts to tilt backward upon receiving a relatively great backward tilting force F, it is merely supported on the floor surface by two one-way rollers 5 due to the fact that its two front leg members are raised from the floor surface. There occurs one point of tangency between one roller 5 and the floor surface, which is an action point of the backward tilting torsion applied to the furniture article. As described hereinabove, the reactive force f in a resistance to the rolling friction is relatively smaller so that the relatively greater backward tilting force F overcomes this relatively smaller reactive force f to cause backward rolling of the one-way rollers 5. As a consequence, the furniture article is driven to move backward, resulting in the points of tangency between the rollers 5 and the floor surface (i.e. the action points of the backward tilting torsions) being moving backward in the course of movement of the furniture article. According to a mechanical principle, a force is unable to produce an active torsion when it is exerted to an action point moving in the same direction. It is therefore easily conceivable that the greater backward tilting force F is exerted to the furniture article, but no active torsion is produced therefrom, as a result, the furniture article will be driven by the backward tilting force F to move backward rather than falling toward the floor surface. The movement of the furniture article comes to an end when the backward tilting force F disappears or the furniture article encounters a reactive force F1 generated by an obstacle. The furniture article then rests against this obstacle or returns to its balance position instead of falling toward the floor surface, due to formation of a return torsion generated by the gravity force to cause rotation of the furniture article towards its front leg members.

It is apparent that one-way rollers may be used in the embodiments as described above to provide better safety of the legged furniture article.

The design of such a one-way roller structure enhances greatly the stability of the furniture article as well as imparts the advantages of easy installation and convenient use to the device of the invention.

Figure 12A:
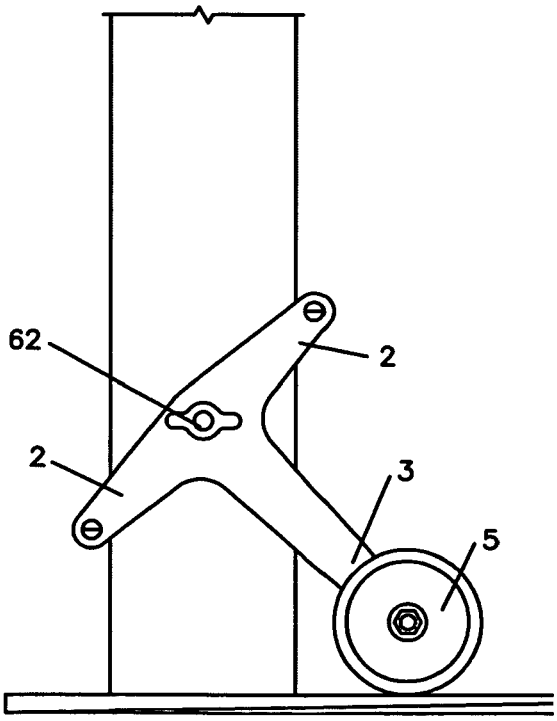
FIG. 12(*a*) is a schematic view of construction of a device for avoiding inattentive-fall of a legged furniture article constructed consistent with a fifth preferred embodiment of the invention with the device attached to a leg member of the furniture article.
Figure 12B:
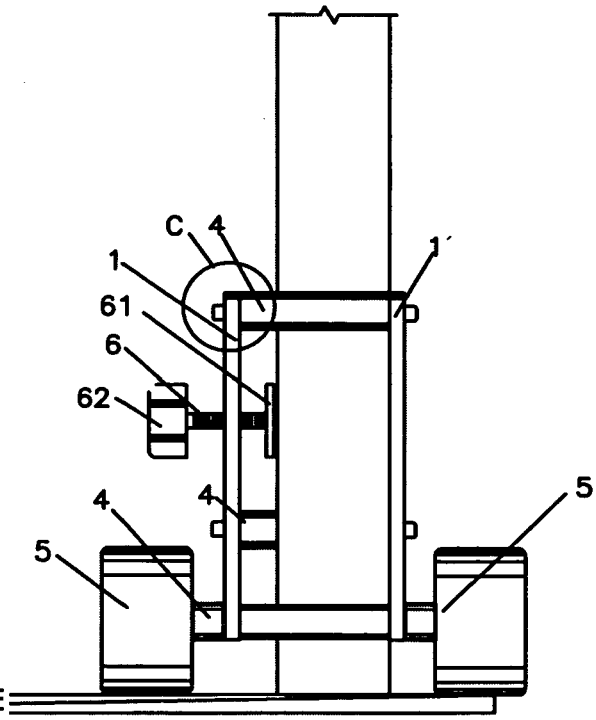
Figure 13:
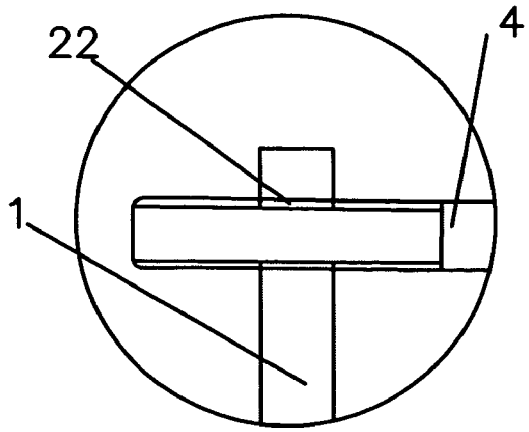
FIG. 13 is a partial view of Section C of FIG. 12(*b*)

FIGS. 12*a* and 12*b* illustrate a device for avoiding inattentive-fall of a legged furniture article consistent with a fifth preferred embodiment of the invention. This embodiment is substantially structurally identical with the third embodiment, but differing in that each transverse arm 2 has a threaded hole 22 (FIG. 13) and each connection member 4 is formed as a screw bolt having two ends with external threads in opposite direction to allow screwing said ends into said threaded holes 22 of the transverse arms 22, in such a manner that the connection members 4 are fixed to the substantially T-shaped members 1, 1' to define the support means 7.

Referring now to FIG. 12*b*, this embodiment differs further in that a pair of rollers 5 are respectively arranged at the external sides of the roller arm 3 to greatly provide the stability of the device when used.

Figure 14:
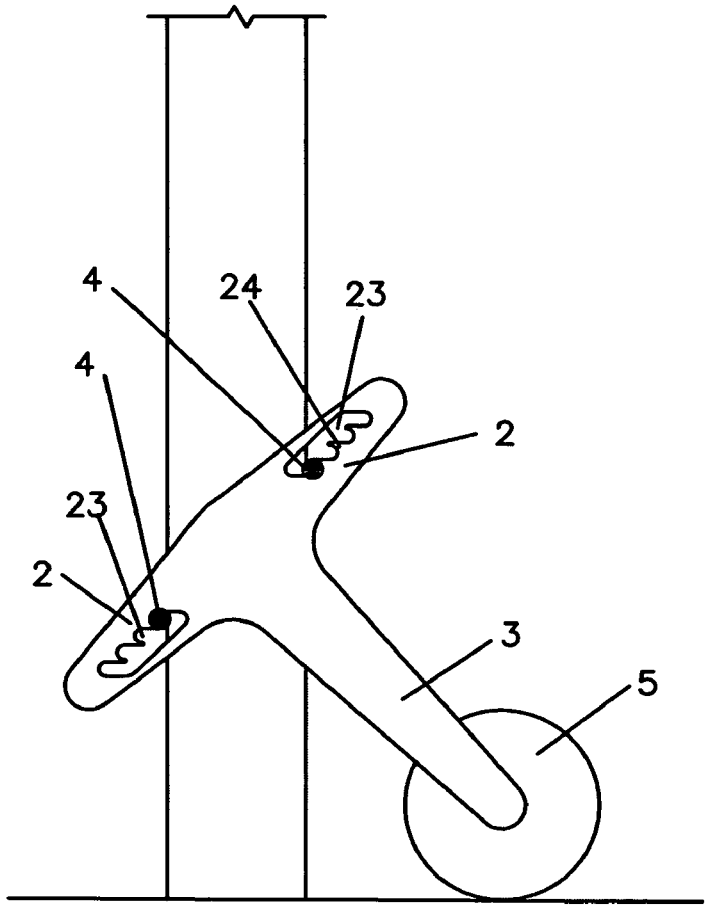
FIG. 14 is a schematic view of construction of a device for avoiding inattentive-fall of a legged furniture article constructed consistent with a sixth preferred embodiment of the invention with the device attached to a leg member of the furniture article.

FIG. 14 illustrates a device for avoiding inattentive-fall of a legged furniture article consistent with a sixth preferred embodiment of the invention. This embodiment is substantially structurally identical with the third embodiment, but differing in that the transverse arms 2 of each substantially T-shaped member 1, 1' are respectively provided with a corresponding toothed groove 23 which is formed as a open groove comprising a plurality of teeth 24 along one edge thereof. The connection members 4 may be matched and engaged with the desirable teeth 24 arranged on the toothed grooves to adjust the spacing of the connection members 4 between the transverse arms 2 in order to fit leg members 8 of different sizes.

Having sufficiently described several embodiments of the present invention, it is stated that insofar as its basic principle is not altered, changed or modified it may be subjected to variations of detail. Numerous variations and modifications that are easily obtainable by means of the skilled person's common knowledge without departing from the scope of the invention should fall into the scope of this invention.

What is claimed is:

1. A device for avoiding inattentive-fall of a legged furniture article, comprising:

a support means having a cavity for passage of a leg member of the furniture article, and including:

a pair of substantially T-shaped members each having two transverse arms and a roller arm which is substantially perpendicular to the transverse arms; and three connection members which are respectively connected on the ends of the respective arms to keep the substantially T-shaped members in a parallel and spaced relation to define the support means with the cavity, wherein the connection member connected on the ends of the roller arm acts as a roller spindle;

and wherein the transverse arms of each substantially T-shaped member are respectively provided with one or more through holes and each connection member has two ends with internal threads to allow connection of said ends with engagable screws extending through said through holes, in such a manner that the connection members are fixed to the substantially T-shaped members; and at least one roller rotatably attached to the connection member that acts as the roller spindle, wherein the roller and the cavity are arranged vertically in a staggered mode.

2. The device as claimed in claim 1, wherein the pair of the transverse arms and the roller arm of the substantially T-shaped member are manufactured integrally, wherein the transverse arms and the roller arm define a joint portion having a threaded hole into which a screw bolt is screwed, one end of the screw bolt extending into the cavity and another end of the screw bolt being used as a clamping end.

3. The device as claimed in claim 2, wherein the end of the screw bolt extending into cavity is fitted with a rubber pad.

4. The device as claimed in claim 1, wherein the roller is a one-way roller.

5. A device that prevents a furniture article having legs from tipping over, comprising:

a support, having:

a pair of substantially T-shaped members, each T-shaped member having two transverse arms, and a roller arm which is substantially perpendicular to the transverse arms, each transverse arm having at least one through hole;

first and second connection members which are respectively connected on ends of the respective transverse arms, each of said first and second connection members having two opposing ends that are internally threaded;

a third connection member that serves as a roller spindle and is connected on an end of the roller arm, the first, second and third connection members maintaining the substantially T-shaped members in a parallel and spaced relation to define a cavity, the cavity receiving a respective leg of the furniture article;

a plurality of threaded fasteners, each threaded fastener extending through a respective through hole and being threaded into a respective end of a respective one of the first and second connection members, to fix the first and second connection members to the substantially T-shaped members; and at least one roller rotatably attached to the third connection member, wherein when the leg is received within the cavity, the roller is disposed adjacent to the leg.

* * * * *